United States Patent [19]

Whatley

[11] 4,149,680

[45] Apr. 17, 1979

[54] PAPER ROLL HOLDER

[76] Inventor: Blanche E. Whatley, 129 E. 12th #20, N. Vancouver, British Colombia, Canada, V7L 2J3

[21] Appl. No.: 824,036

[22] Filed: Aug. 12, 1977

[51] Int. Cl.[2] ..... A47K 10/22

[52] U.S. Cl. ..... 242/55.2

[58] Field of Search ..... 242/55.2, 55.53

[56] References Cited

U.S. PATENT DOCUMENTS

| | | | |
|---|---|---|---|
| 2,477,961 | 8/1949 | Campbell | 242/55.2 |
| 2,486,678 | 11/1949 | Rashko | 242/55.2 |
| 2,513,699 | 7/1950 | Williams | 242/55.2 |
| 3,346,208 | 10/1967 | Hoffman et al. | 242/55.2 |

FOREIGN PATENT DOCUMENTS

| | | | |
|---|---|---|---|
| 811960 | 4/1959 | United Kingdom | 242/55.2 |

*Primary Examiner*—George F. Mautz

*Attorney, Agent, or Firm*—Eugene M. Eckelman

[57] ABSTRACT

A body member has an arm leading angularly outwardly therefrom, and a spindle leads from the arm in parallel relation to the body member. The spindle has an upwardly extending retainer or hook on the end thereof for engaging the edge of a core on which the paper roll is wound to restrain rotation of the roll. The spindle is angled rearwardly to cause the core of the roll to frictionally engage both the top and bottom edges of the spindle to further restrain turning movement of the roll. Such spindle also may have a rearward projection which acts as a stabilizer and further restrains rolling movement of the paper roll. Also, an edge of the spindle can be serrated to restrain rolling movement, or if desired a semi-circular serrated projection can form a part of the spindle to restrain rolling movement of the paper roll.

4 Claims, 9 Drawing Figures

PAPER ROLL HOLDER

BACKGROUND OF THE INVENTION

This invention relates to new and useful improvements in paper roll holders.

Paper roll holders have heretofore been provided for holding toilet tissue, paper towels, etc. Some of such holders allow the paper roll to turn freely, thus making it difficult to tear off a desired amount of paper except by using two hands. Other holders employ means to restrict rotation of the paper roll, but such holders are generally complex in construction and add materially to the cost. In addition, the prior holders that restrain rotation of the roll of paper have structure which engages the paper in the roll and not just the core and such damages the paper. Furthermore, most of the holders in present use are of a structure which makes it difficult to install a roll thereon.

SUMMARY OF THE INVENTION

According to the present invention and forming a primary objective thereof, a paper roll holder is provided which is extremely simple in construction, which is inexpensive to manufacture, which is attractive in appearance, which has brake means engageable only with the core of the roll so as not to damage the paper and which is constructed so as to provide easy sliding on and removal of a roll.

In carrying out the above objectives, a paper roll holder is provided which employs a simple structure having a body member, an arm leading angularly outwardly from the body member at approximately right angles, a spindle leading angularly from the outer end of the arm in substantially parallel relation with the body member, and an upwardly extending retainer on the end of the spindle which has a construction providing frictional engagement with the core of the roll. The spindle is tilted rearwardly and dimensioned so as to frictionally engage both the top and bottom edges of the core. Other embodiments of spindle structure are employed which increase the turning resistance of the roll.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figure 2:
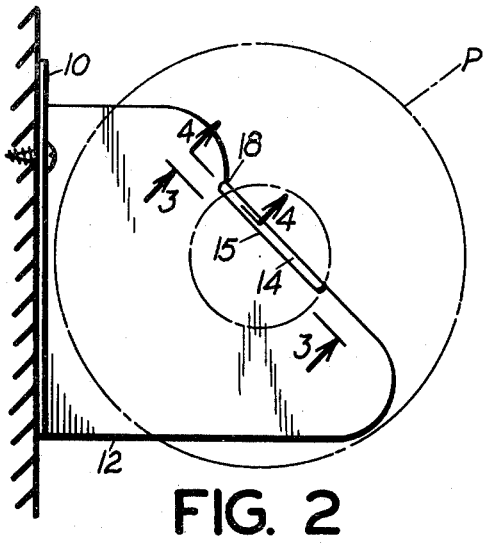
FIG. 2 is an end elevational view of the spindle, this view being taken on the line 2—2 of FIG. 1.
Figure 1:
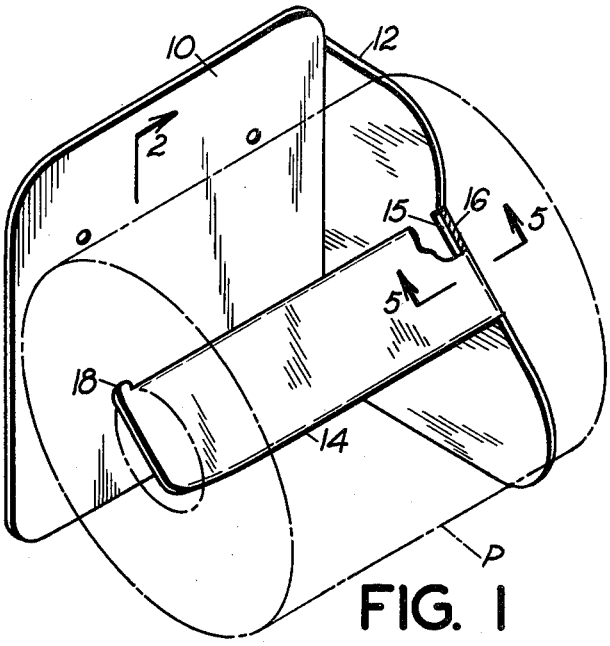
FIG. 1 is a perspective view of a paper roll holder embodying features of the present invention.
Figure 3:
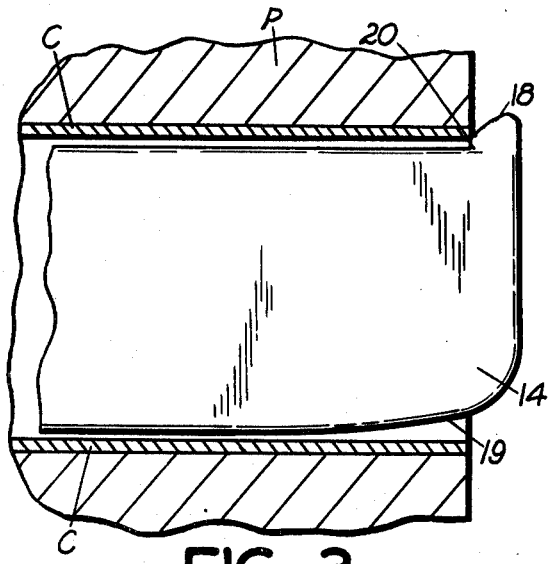
FIG. 3 is an enlarged sectional view of the holder taken on the line 3—3 of FIG. 2.
Figure 4:
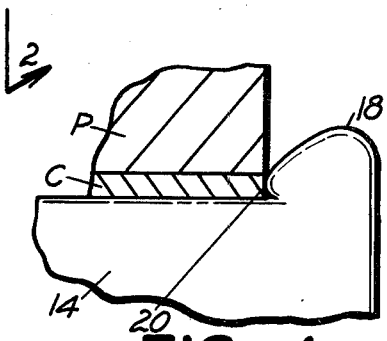
FIG. 4 is an enlarged fragmentary sectional view taken on the line 4—4 of FIG. 2.

With particular reference to the drawings, and first to FIGS. 1–6, the paper roll holder of the invention comprises a plate-like body member 10 adapted to be secured to a wall or the like by suitable fastening means such as screws, pressure sensitive adhesive, etc., not shown. This body member has an arm 12 leading outwardly from one end thereof at approximately a right angle. Arm 12 integrally supports a blade-like spindle 14 which extends substantially parallel with the body member 10 in front thereof for supporting a roll of paper P, shown in broken lines, having a core C on which the paper is wound. In a preferred arrangement, the spindle leads from the front edge of arm 12 at a point intermediate the upper and lower ends of the latter. In a preferred structure the spindle seats in a recess 15 in the front edge of arm 12 so that its front surface will be flush with the front edge of the arm, and such spindle has an angled end portion 16 which lies on the side surface of arm 12 and which is tapered to a thinned edge 17 at its ends for attractive appearance, FIG. 5. The spindle is adhesively secured to the arm in the recess 15 and to the side surface, and by such arrangement has reinforced support on the holder. The portion of the arm 12 below the spindle extends forwardly and downwardly to provide a large end surface adapted for engagement by one end of a roll of paper supported on the spindle. The spindle is tilted rearwardly and has an upwardly extending inturned retainer or hook 18, best shown in FIGS. 3 and 4, on its free end. The purpose of the retainer 18 is to hold a roll of paper on the spindle and also to serve as a brake so that the roll will not turn too freely. That is, the length of the spindle between the inner surface of arm 12 and the innermost edge portion 20 of the retainer is the same as the width of the roll so that the core of the roll will be compressed frictionally between the inner surface of arm 12 and the retainer. The upright dimension of the spindle 14 at the retainer 18 is slightly less than the open core diameter of a roll of paper, whereby such a roll can be moved over the outer end of the spindle and when released will rest by gravity on the spindle. The dimensional relationship of the spindle at the retainer end allows free movement of the roll of paper onto and off the spindle but at the same time adequately holds the roll in place. The roll of paper cannot ordinarily be displaced except by intentional removal. The bottom edge of the spindle at the outer end thereof is angled upwardly a slight amount, designated by the numeral 19, to aid in sliding on a roll of paper.

Since the spindle 14 is tilted rearwardly and since the upright dimension thereof is only slightly less than the inner diameter of the core C of the paper roll P, the core will engage both edges of the spindle. This is illustrated in FIG. 2, and a restraining force on the turning of the roll is provided by both of said spindle edges. This is in addition to the restraining force provided by the friction engagement of the roll against arm 12 and the retainer 18. Since retainer 18 projects upwardly only a short distance at the point of contact with the roll, it will engage only the core of the roll and not the paper in the roll itself so that no damage is done to the paper.

Figure 6:
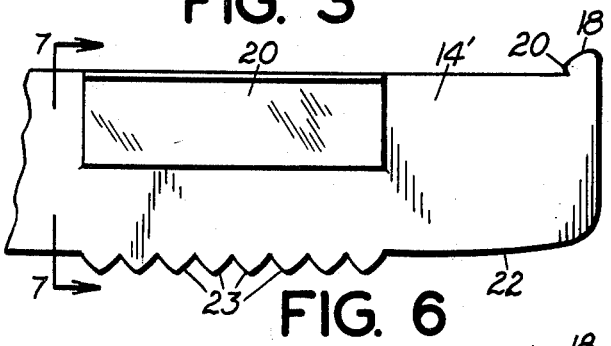
FIG. 6 is a fragmentary elevational view of a modified form of spindle construction.
Figure 7:
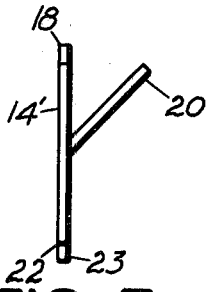
FIG. 7 is a sectional view taken on the line 7—7 of FIG. 6.

With reference to FIGS. 6 and 7, a modified spindle construction is shown which can be used to apply turning resistance to a roll. For this purpose, a rearward projection 20 extends integrally from the spindle 14' and is of a rearward projecting length so that it is in close proximity to the inside surface of the paper roll core. When a sideways and downward pull is applied to the roll as when tearing off a portion of the roll, rotation of the roll is restrained sufficiently so that such portion can be torn off by a quick pull. Thus, paper can be removed from the roll with one hand. Projection 20 can be of any desired length along the spindle, namely, it can extend substantially the full length or it can be only a partial length as shown. Projection 20 also serves as a stabilizer in the turning movement of the roll.

In addition, the lower edge 22 of the spindle 14' can have serrations 23 provided therein to further apply a braking effect. Projection 20 can be used along or with a serrated edge 23.

Figure 8:
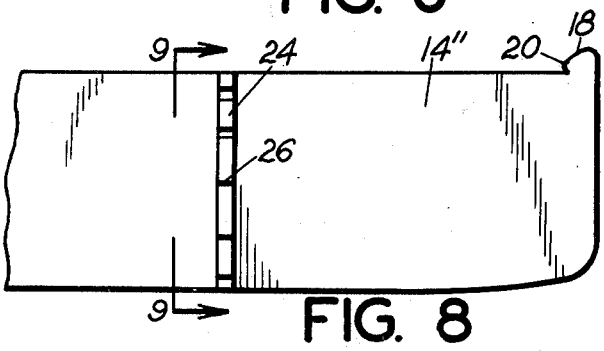
FIG. 8 is a fragmentary elevational view of another form of spindle construction.
Figure 9:
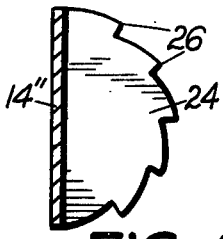
FIG. 9 is a sectional view taken on the line 9—9 of FIG. 8.
Figure 5:
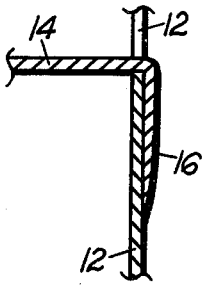
FIG. 5 is an enlarged fragmentary sectional view taken on the line 5—5 of FIG. 1.

With reference to FIGS. 8 and 9 a further modification is illustrated wherein the spindle 14'' has a semi-circular, narrow tab-like projection 24 on its rear surface which provides a braking effect in addition to the braking effect of the retainer 18 and the top and bottom edges of the spindle. The rounded rearward edge of such projection engages the core of the roll to provide the additional braking effect and is serrated at 26 with downturned teeth for additional friction. Projection 24 also acts as a stabilizer in the turning movement of the roll.

It is apparent that the present holder has many advantages, namely, it does not employ any springs or moving parts. It is inexpensive to manufacture and provides for easy installation of a roll of paper and removal of the core. It does not damage the paper on the roll and applies enough tension on the roll so that a small number of sheets of paper can be torn off with one hand. Substantially any size of roll can be supported on the holder.

It is to be understood that the forms of my invention herein shown and described are to be taken as preferred examples of the same and that various other changes in the shape, size and arrangement of parts may be resorted to without departing from the spirit of my invention or the scope of the subjoined claims. For example, the holder 10 may stand upright on a counter surface, namely, the arm 12 may comprise the base in which case fastening means can be provided between the arm and the counter. It is also to be understood that the spindle 14 could be of a length to hold two or more rolls or one long roll such as paper towels. Also, while the spindle 14 is shown to have a rearward incline, it could also have a forward incline. In addition, a projection 24 as in FIGS. 8 and 9 can be used on the forward surface of the spindle, and in such case it is preferred that the serrations 26 comprise teeth that face upwardly instead of downwardly.

Having thus described my invention, I claim:

1. A holder for a roll of paper of the type having flat end surfaces and an axial core member extending through the roll between said surface, said holder comprising (a) a body member, (b) means arranged to mount said body member vertically on a supporting surface, (c) an arm leading forwardly from said body member at approximately a right angle thereto and having an outer end, (d) a plate-like spindle leading angularly from said arm in spaced relation to said body member, (e) said spindle having front and rear faces, top and bottom edges, and an outer free end, (f) said spindle being of uniform dimension between its top and bottom edges and being disposed in a rearwardly tilted position relative to said body member whereby both of its top and bottom edges are engaged by the core member of a roll of paper in the rest position of the roll of paper on the spindle as well as when paper is being unrolled from the roll, (g) and an upwardly extending retainer on said free end dimensioned and arranged to engage an edge only of the core of the roll for holding the roll on the spindle and compressing the core between said retainer and said arm for applying a braking effect to turning movement of the roll.

2. The holder of claim 1 including a projection leading rearwardly from said rear face of the spindle between said top and bottom edges for additionally engaging an inner defining portion of the core of a roll of paper to provide friction drag on turning movement of the roll of paper.

3. The holder of claim 1 wherein at least one of said top and bottom edges of said spindle have serrations therein to provide additional drag on turning movement of a roll of paper.

4. The holder of claim 1 including a semi-circular serrated projection on one of said front or rear faces of said spindle for providing drag on turning movement of a roll of paper.

* * * * *